US009188947B2

(12) United States Patent
Kobayashi

(10) Patent No.: US 9,188,947 B2
(45) Date of Patent: Nov. 17, 2015

(54) IMAGE FORMING APPARATUS WITH SEALING FRAME STRUCTURE

(71) Applicant: KYOCERA Document Solutions Inc., Osaka-shi, Osaka (JP)

(72) Inventor: Tatsuya Kobayashi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/137,024

(22) Filed: Dec. 20, 2013

(65) Prior Publication Data

US 2014/0186068 A1 Jul. 3, 2014

(30) Foreign Application Priority Data

Dec. 27, 2012 (JP) ..... 2012-285866

(51) Int. Cl.
*G03G 15/00* (2006.01)
*G03G 21/18* (2006.01)
*G03G 21/16* (2006.01)

(52) U.S. Cl.
CPC ..... *G03G 21/1652* (2013.01); *G03G 21/1647* (2013.01)

(58) Field of Classification Search
CPC ..... G03G 21/1619; G03G 21/1642; G03G 21/1652; G03G 21/1661; G03G 21/1695; G03G 2221/1678; G03G 2221/169
See application file for complete search history.

(56) References Cited

U.S. PATENT DOCUMENTS

| | | | | |
|---|---|---|---|---|
| 5,631,726 | A * | 5/1997 | Sawada | 399/111 |
| 7,369,788 | B2 * | 5/2008 | Omura et al. | 399/88 |
| 7,894,743 | B2 * | 2/2011 | Tomatsu | 399/107 |
| 2003/0156854 | A1 * | 8/2003 | Sugita | 399/90 |
| 2004/0095456 | A1 * | 5/2004 | Yoshihara et al. | 347/152 |
| 2009/0179528 | A1 * | 7/2009 | Omura et al. | 310/68 B |
| 2011/0299874 | A1 | 12/2011 | Fujiwara | |

FOREIGN PATENT DOCUMENTS

| | | | |
|---|---|---|---|
| JP | 2005031447 | A | 2/2005 |
| JP | 2005037520 | A | 2/2005 |
| JP | 2006139121 | A | 6/2006 |
| JP | 2012018394 | A | 1/2012 |

* cited by examiner

*Primary Examiner* — Clayton E Laballe
*Assistant Examiner* — Victor Verbitsky
(74) *Attorney, Agent, or Firm* — Alleman Hall McCoy Russell & Tuttle LLP

(57) ABSTRACT

An image forming apparatus includes image forming unit, frame structure, a plurality of rotational shafts, a plurality of drive gears, resin drive housing, and high voltage substrate. The frame structure includes at least one metal side plate frame having inner side surface facing internal space that accommodates the aforementioned unit and outer side surface opposite the inner side surface. The plurality of drive gears each rotate about an axis of the rotational shaft. The drive housing includes supporting side surface that supports one end of the rotational shaft and cavity in which the plurality of drive gears is accommodated, and the drive housing is open at the other end of the rotational shaft. The drive housing includes substrate supporting portion that supports the high voltage substrate, and is attached to the side plate frame such that the opening is sealed by the inner side surface of the side plate frame.

2 Claims, 12 Drawing Sheets

IMAGE FORMING APPARATUS WITH SEALING FRAME STRUCTURE

INCORPORATION BY REFERENCE

This application is based upon and claims the benefit of priority from the corresponding Japanese Patent Application No. 2012-285866 filed on Dec. 27, 2012, the entire contents of which are incorporated herein by reference.

BACKGROUND

The present disclosure relates to an image forming apparatus that performs image forming processing on a sheet.

Image forming apparatuses such as a copier, a printer, and a facsimile include a housing structure that is formed by a sheet metal frame structure generally including a side plate frame, and a plurality of processing units for performing image forming processing are disposed in the internal space of the housing structure. The above-mentioned processing units may be, for example, a drum unit including a photosensitive drum that forms a toner image, and a developing unit that supplies toner to the photosensitive drum and forms a toner image on the photosensitive drum. For example, a high voltage substrate that supplies an operating voltage to the processing units and a drive gear unit that transmits driving force to driven members (e.g., a photosensitive drum and a developing roller) provided in the processing units may be assembled to the side plate frame.

SUMMARY

An image forming apparatus according to one aspect of the present disclosure includes an image forming unit, a frame structure, a plurality of rotational shafts, a plurality of drive gears, a resin drive housing, and a high voltage substrate. The frame structure is a frame structure forming a housing structure including an internal space that accommodates the aforementioned unit, and includes at least one metal side plate frame having an inner side surface facing the internal space and an outer side surface opposite the inner side surface. The plurality of drive gears each rotate about an axis of the rotational shaft. The drive housing includes a supporting side surface that supports one end of the rotational shaft and a cavity in which the plurality of drive gears is accommodated and the drive housing is open at the other end of the rotational shaft. The high voltage substrate carries an electric component for operating the image forming unit. The drive housing includes a substrate supporting portion that supports the high voltage substrate, and is attached to the side plate frame such that the opening is sealed by the inner side surface of the side plate frame.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
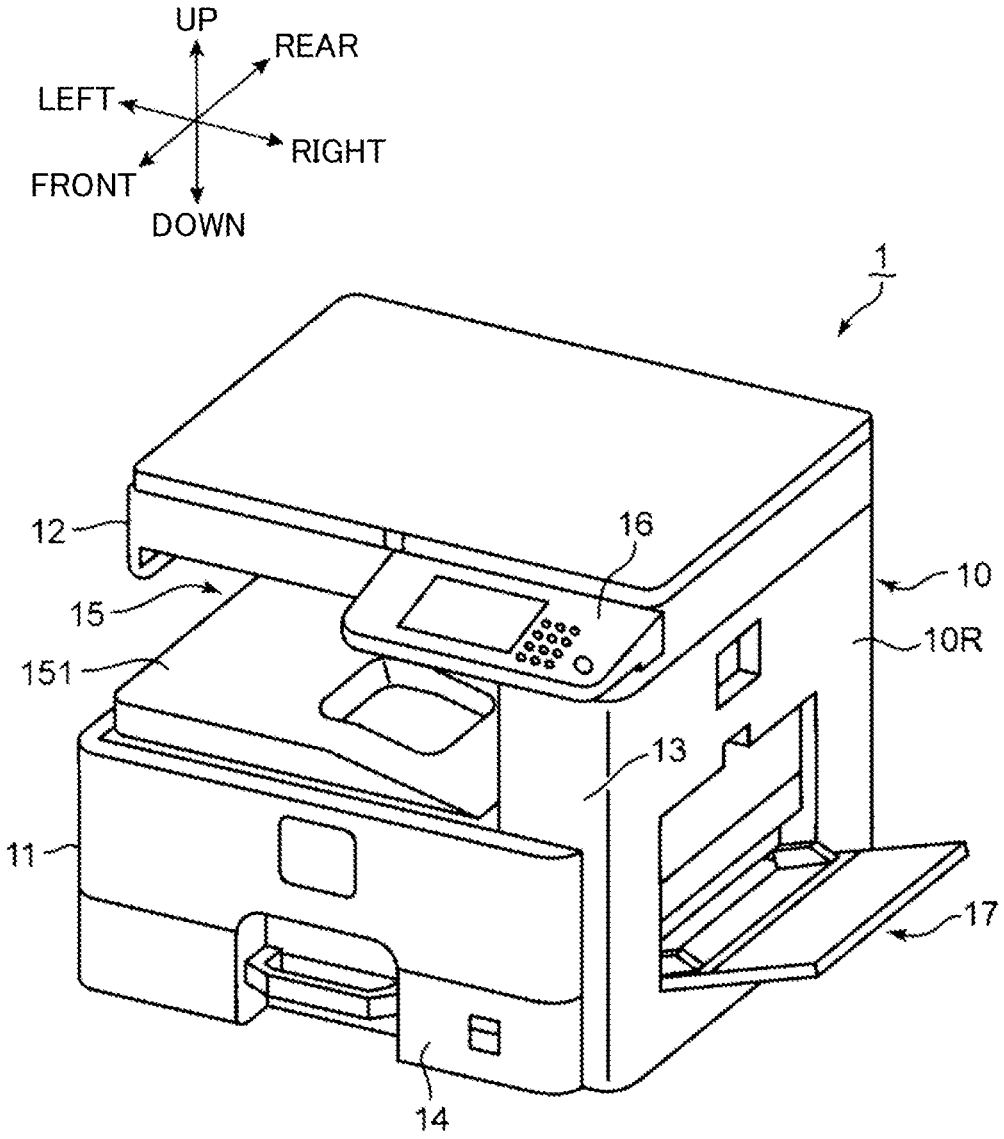
FIG. 1 is an external perspective view of an image forming apparatus according to an embodiment of the present disclosure.

Hereinafter, an embodiment according to the present disclosure will be described with reference to the drawings. FIG. 1 is an external perspective view of an image forming apparatus 1 according to an embodiment of the present disclosure. The image forming apparatus 1 is a monochrome printer having a copying function, and includes a body housing 10 having a box shape. The body housing 10 includes a lower housing 11, an upper housing 12 disposed above the lower housing 11, and a connecting housing 13 disposed between the lower housing 11 and the upper housing 12 on the side of a right side surface 10R of the body housing 10.

The lower housing 11 accommodates various units for performing image forming processing on a sheet. The upper housing 12 is used when the image forming apparatus 1 functions as a copier, and accommodates a scanner device that optically reads an image on a document sheet. A sheet cassette 14 that stores a bundle of sheets on which image forming processing is to be performed is removably mounted to the front surface of the lower housing 11. The body housing 10 includes an in-body sheet discharge space 15 into which a sheet that has been subjected to image forming processing is discharged. The in-body sheet discharge space 15 is a space defined by the top surface of the lower housing 11, the undersurface of the upper housing 12, and the left side surface of the connecting housing 13. An in-body sheet discharge tray 151 that receives the sheet is provided at the bottom of the in-body sheet discharge space 15. An operation panel 16 that receives user operation information that is input to the image forming apparatus 1 is attached to the front surface of the upper housing 12. Additionally, a manual feed tray 17 for manually feeding sheets is provided on the right side surface 10R of the body housing 10 so as to be openable and closable with respect to the right side surface 10R.

Figure 2:
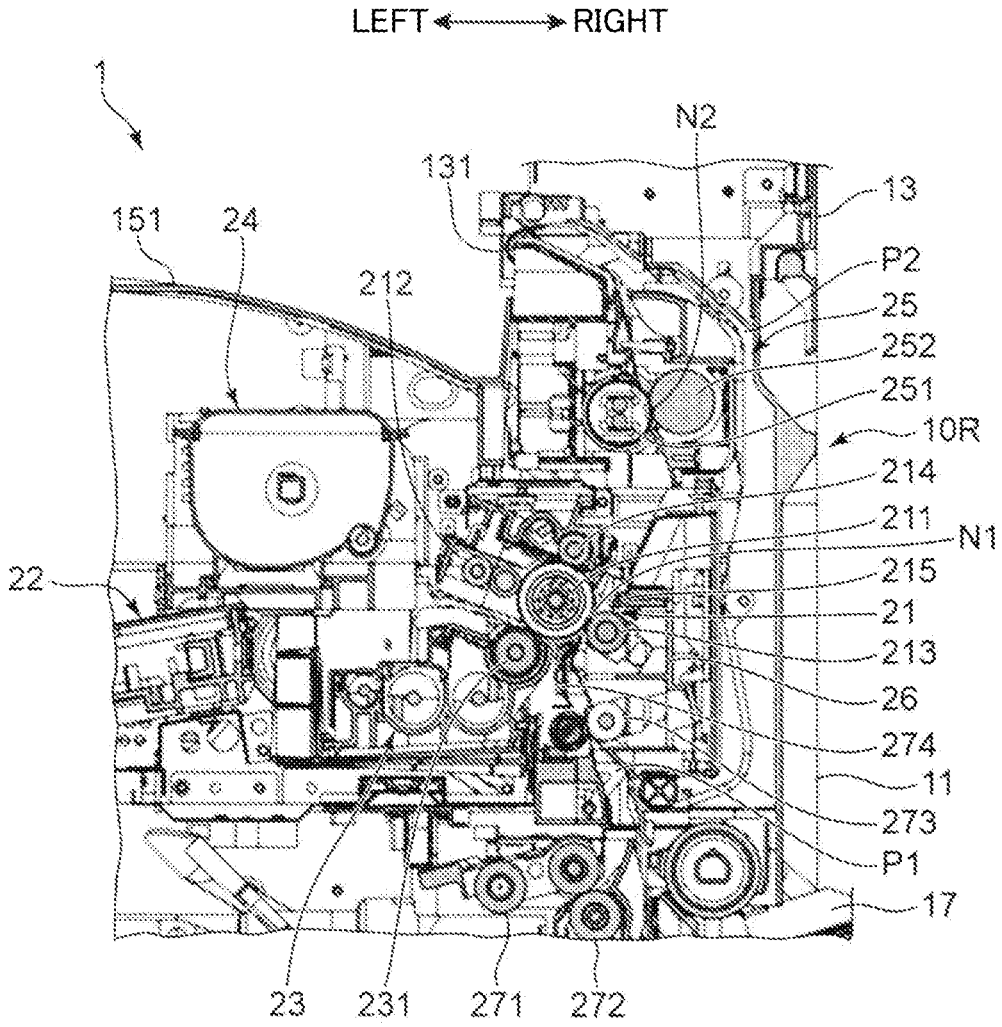
FIG. 2 is a sectional view showing relevant portions of an internal structure of the image forming apparatus shown in FIG. 1.

FIG. 2 is a sectional view showing relevant portions of the internal structure of the image forming apparatus 1. FIG. 2 shows a sectional view in the right-left direction of an upper part of the right half of the lower housing 11 and the connecting housing 13. As image forming units, a drum unit 21, an exposure unit 22, a developing unit 23, a toner container 24, a fixing unit 25, a conveyance unit 26, and so forth are accommodated within the lower housing 11. Each of these units can be separately removed from the lower housing 11 (a frame structure 30, which will be described later).

The drum unit 21 is a unit including a photosensitive drum 211, and a charging device 212 and a cleaning device 214 disposed around the photosensitive drum 211. The developing unit 23 is a unit including a developing roller 231 that is abutted against the photosensitive drum 211. The conveyance unit 26 carries a transfer roller 213 that is abutted against the photosensitive drum 211.

The photosensitive drum 211 rotates about its axis and has a circumferential surface on which an electrostatic latent image and a toner image are formed. The charging device 212 uniformly charges the circumferential surface of the photosensitive drum 211. The exposure unit 22 applies laser light to the circumferential surface of the photosensitive drum 211 in order to form the electrostatic latent image. The developing roller 231 of the developing unit 23 supplies toner to the circumferential surface of the photosensitive drum 211 in order to develop the electrostatic latent image formed on the circumferential surface of the photosensitive drum 211. The transfer roller 213 forms a transfer nip portion N1 between itself and the photosensitive drum 211, and transfers the toner image on the photosensitive drum 211 to a sheet. The cleaning device 214 cleans the circumferential surface of the photosensitive drum 211 having the toner image transferred thereon. The toner container 24 supplies toner to the developing unit 23.

The fixing unit 25 includes a fixing roller 251 in which a heat source is included and a pressure roller 252 forming a fixing nip portion N2 between itself and the fixing roller 251. The fixing unit 25 performs a fixing process on the sheet having the toner image transferred thereon in the transfer nip portion N1 by applying heat and pressure to the sheet in the fixing nip portion N2. The sheet that has been subjected to the fixing process is discharged from a sheet discharge port 131 toward the in-body sheet discharge tray 151.

A sheet conveyance path along which a sheet is conveyed is provided within the body housing 10. The sheet conveyance path includes a main conveyance path P1 extending in the up-down direction from a region near the lower portion of the lower housing 11 through the connecting housing 13 via the transfer nip portion N1 and the fixing nip portion N2 to reach the sheet discharge port 131. Additionally, a reverse conveyance path P2 along which a sheet is inverted and conveyed during duplex printing is provided extending from the most downstream end to a region near the upstream end of the main conveyance path P1.

The sheet cassette 14 includes a sheet accommodating portion that accommodates a bundle of sheets. Near the upper right region of the sheet accommodating portion are provided a pickup roller 271 that picks up one by one the top sheet of the bundle of sheets and a sheet feed roller pair 272 that sends out the picked-up sheet to the upstream end of the main conveyance path P1. A registration roller pair 273 that sends out a sheet to the transfer nip portion N1 at a predetermined timing is disposed along the main conveyance path P1 at a location upstream of the transfer nip portion N1.

The main conveyance path P1 and the reverse conveyance path P2 are formed using the inner side surface (left side surface) and the outer side surface (right side surface) of the conveyance unit 26. For example, the main conveyance path P1 directly upstream of the transfer nip portion N1 is defined by the inner side surface of the conveyance unit 26 and a pre-transfer guide 274 disposed facing therewith. The conveyance unit 26 carries, in addition to the transfer roller 213 described above, one of the rollers of the registration roller pair 273 and one of the rollers of a conveyance roller pair (not shown) that transports a sheet along the reverse conveyance path P2.

Image forming operations performed by the image forming apparatus 1 will be described briefly. First, the charging device 212 charges the circumferential surface of the photosensitive drum 211 substantially uniformly. The circumferential surface of the charged photosensitive drum 211 is exposed by the laser light emitted from the exposure unit 22, and thereby an electrostatic latent image of an image to be formed on the sheet is formed on the circumferential surface of the photosensitive drum 211. This electrostatic latent image is made visible as a toner image by supplying toner from the developing unit 23 to the circumferential surface of the photosensitive drum 211.

When a sheet is subjected to a single-sided printing process, the sheet is sent out from the sheet cassette 14 or the manual feed tray 17 to the main conveyance path P1, and the sheet is subjected to the transfer process of the toner image in the transfer nip portion N1 and the fixing process that fixes the transferred toner to the sheet in the fixing nip portion N2. Thereafter, the sheet is discharged from the sheet discharge port 131 onto the in-body sheet discharge tray 151. On the other hand, when a sheet is subjected to a duplex printing process, one side of the sheet is subjected to the transfer process and the fixing process, and then the sheet is partly discharged from the sheet discharge port 131 onto the in-body sheet discharge tray 151. Thereafter, the sheet is switched back through the reverse conveyance path P2 to a region near the upstream end of the main conveyance path P1. Thereafter, the other side of the sheet is subjected to the transfer process and the fixing process, and the sheet is discharged from the sheet discharge port 131 onto the in-body sheet discharge tray 151.

Figure 3:
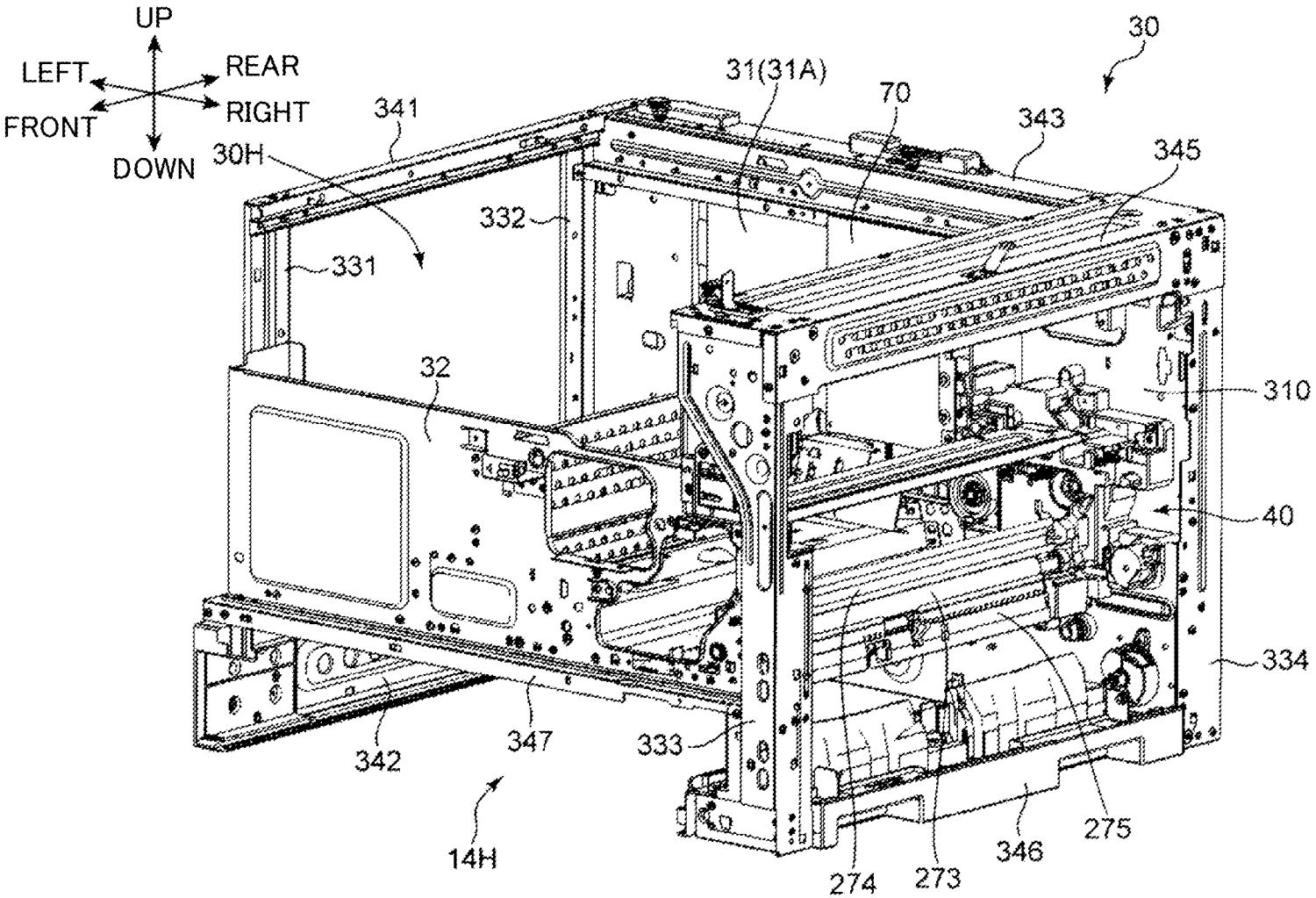
FIG. 3 is a perspective view showing a frame structure of the image forming apparatus shown in FIG. 1 as viewed from the front upper right side.
Figure 4:
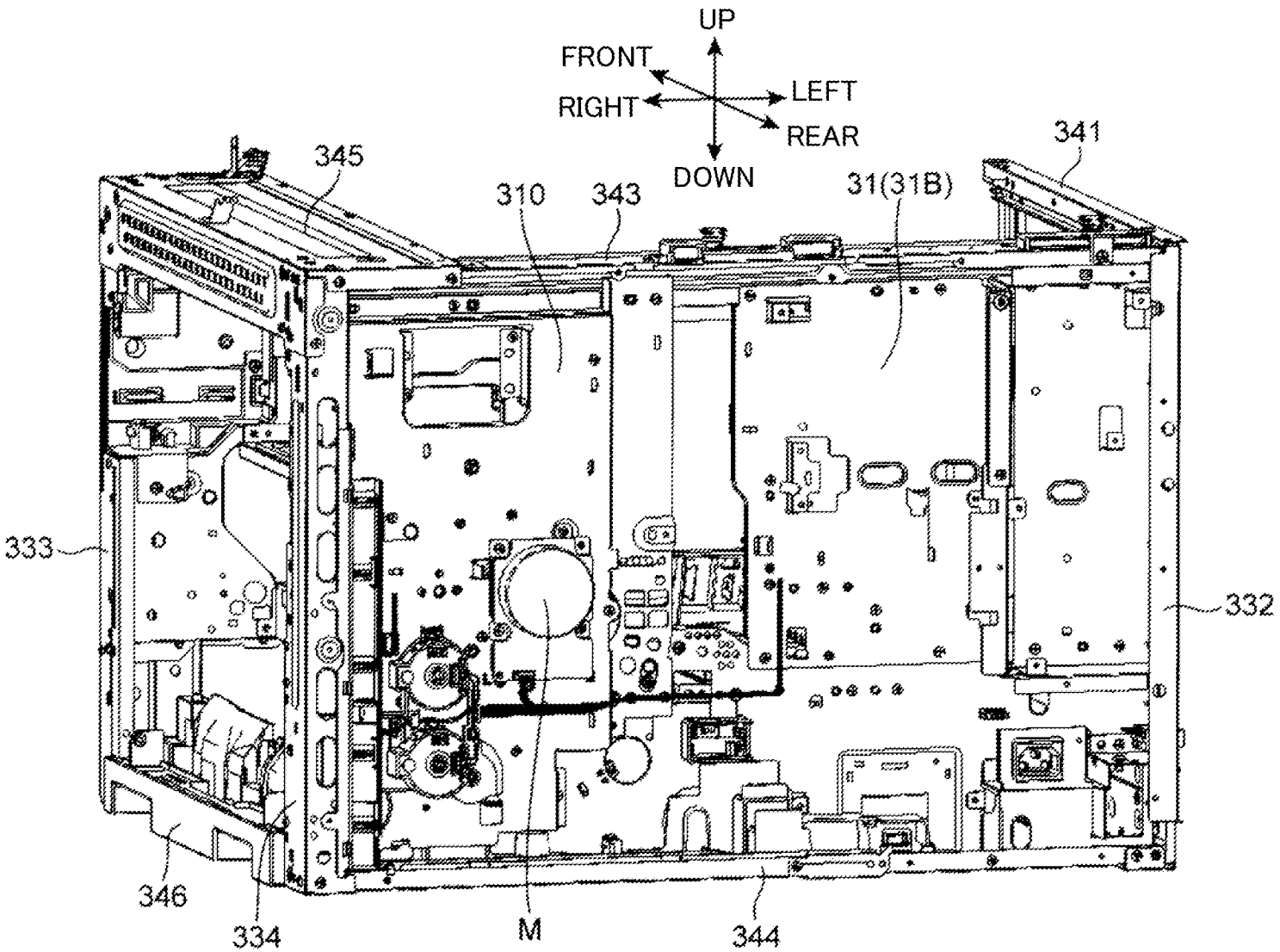
FIG. 4 is a perspective view of the frame structure of the image forming apparatus shown in FIG. 1 as viewed from the rear upper right side.

Next, the frame structure 30 according to the present embodiment will be described. FIG. 3 is a perspective view of the frame structure 30 as viewed from the front upper right side. FIG. 4 is a perspective view of the frame structure 30 as viewed from the rear upper right side. The frame structure 30 is incorporated into the lower housing 11, and is a frame structure that forms a housing structure including an internal space 30H that accommodates the drum unit 21, the exposure unit 22, the developing unit 23, the toner container 24, the fixing unit 25, and the conveyance unit 26 described above.

The frame structure 30 is formed of a sheet metal member, and includes a rear side plate frame 31 (side plate frame), a front side plate frame 32, rod-shaped first, second, third, and fourth vertical frames 331, 332, 333, and 334, and rod-shaped first, second, third, fourth, fifth, sixth, and seventh horizontal frames 341, 342, 343, 344, 345, 346, and 347.

The first and second vertical frames 331 and 332 are provided upright parallel to each other with an interval in the front-rear direction. The upper ends and the lower ends of the first and second vertical frames 331 and 332 are respectively connected by the first and second horizontal frames 341 and 342 extending in the front-rear direction. A square-frame-shaped frame assembly formed by the four rod-shaped frames 331, 332, 341, and 342 constitutes the left side wall of the frame structure 30. The third and fourth vertical frames 333 and 334 are provided upright parallel to each other with an interval in the front-rear direction. The upper ends and the lower ends of the third and fourth vertical frames 333 and 334 are respectively connected by the fifth and sixth horizontal frames 345 and 346 extending in the front-rear direction. A square-frame-shaped frame assembly formed by the four rod-shaped frames 333, 334, 345, and 346 constitutes the right side wall of the frame structure 30.

The second and fourth vertical frames 332 and 334, which are the vertical frames on the rear side, hold the left edge and the right edge, respectively, of the rear side plate frame 31. The upper ends and the lower ends of the second and fourth vertical frames 332 and 334 are respectively connected by the third and fourth horizontal frames 343 and 344 extending in the left-right direction. The third and the fourth horizontal frames 343 and 344 hold the upper edge and the lower edge, respectively, of the rear side plate frame 31. In other words, the four rod-shaped frames 332, 334, 343, and 344 form a square-frame-shaped frame assembly, and the opening of the square-frame-shaped frame assembly is substantially closed by the rear side plate frame 31. Actually, the rear side plate frame 31 is divided into several side plate pieces. For example, the rightward portion of the rear side plate frame 31 is constituted by a vertically elongated side plate frame piece 310 (see FIG. 5).

The first and third vertical frames 331 and 333, which are the vertical frames on the front side, hold the left edge and the right edge, respectively, of the front side plate frame 32. The front side plate frame 32 is a side plate frame having a vertical width that is about half the height of the first and the third vertical frames 331 and 333. A lower edge portion of the front side plate frame 32 is at a position higher than the bottom portion of the frame structure 30. The lower edge portion is supported by the seventh horizontal frames 347 extending in the left-right direction. A gate-shaped opening 14H defined by the lower end portions of the first and third vertical frame 331 and 333 and the seventh horizontal frames 347 is an opening through which the sheet cassette 14 is mounted.

FIG. 3 shows the frame structure 30 in a state in which various units are not mounted in the internal space 30H, but the above-described pre-transfer guide 274 and a conveyance guide member 275 that holds one of the rollers of the registration roller pair 273 are mounted. The rear side plate frame 31 includes an inner side surface 31A facing the internal space 30H and an outer side surface 31B opposite the inner side surface 31A. The outer side surface 31B is a surface facing the inner surface of the exterior member of the lower housing 11. A drive housing 40 that accommodates a drive gear group 50 of a plurality of drive gears (see FIG. 6) is attached to the inner side surface 31A of the rear side plate frame 31. Using the drive housing 40, the rear end portions of the pre-transfer guide 274 and the conveyance guide member 275 are positioned and fixed. Furthermore, the drive housing 40 also serves as a member that supports a high voltage substrate 70. Meanwhile, a drive motor M (FIG. 4) that provides rotational driving force to the drive gear group 50 is attached to the outer side surface 31B of the rear side plate frame 31. In the following, the configuration of the drive housing 40 and the associated configurations will be described in detail.

Figure 5:
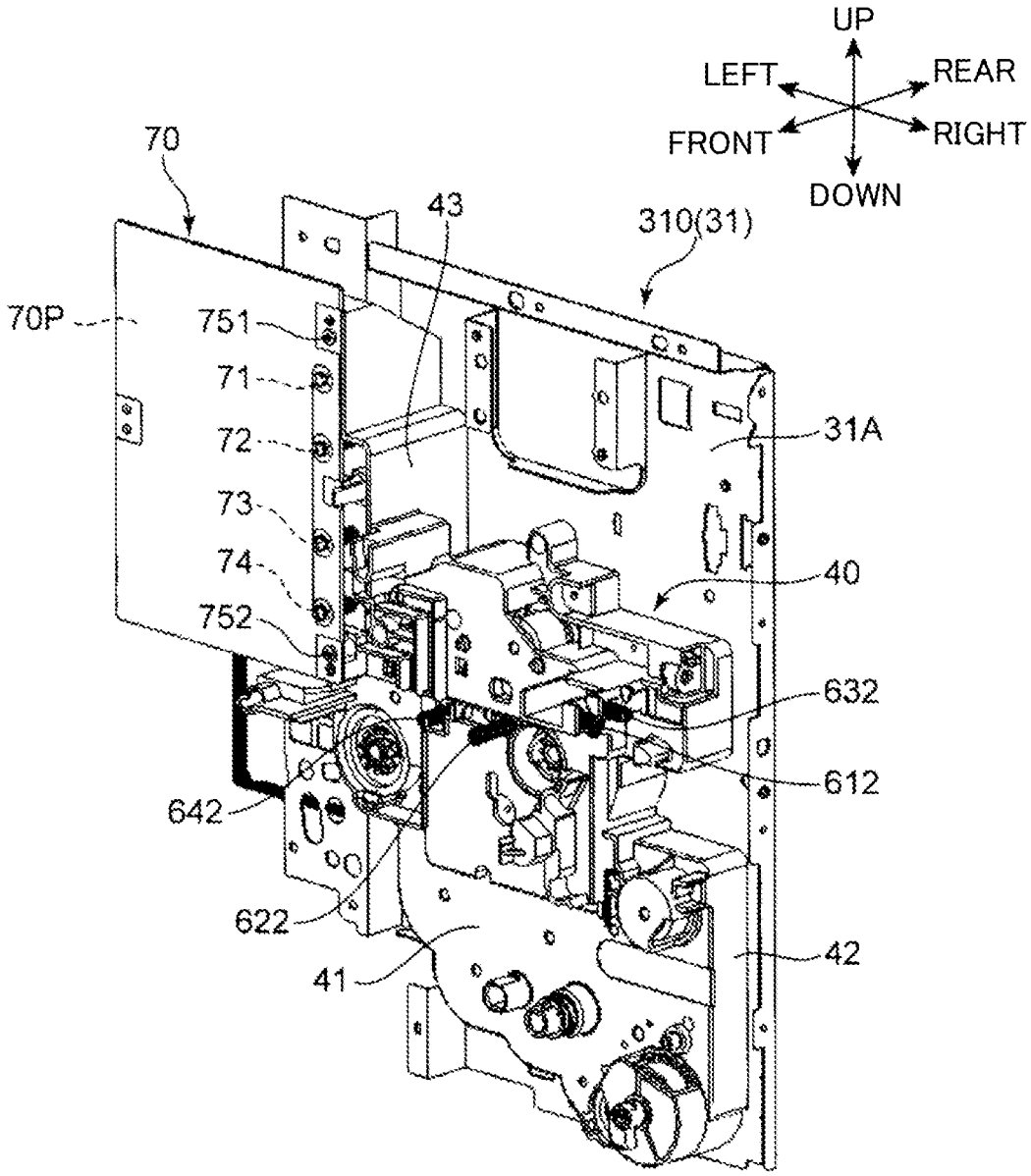
FIG. 5 is a perspective view showing a drive housing to which a high voltage substrate of the image forming apparatus shown in FIG. 1 is attached, and a part of a rear side plate frame.
Figure 6:
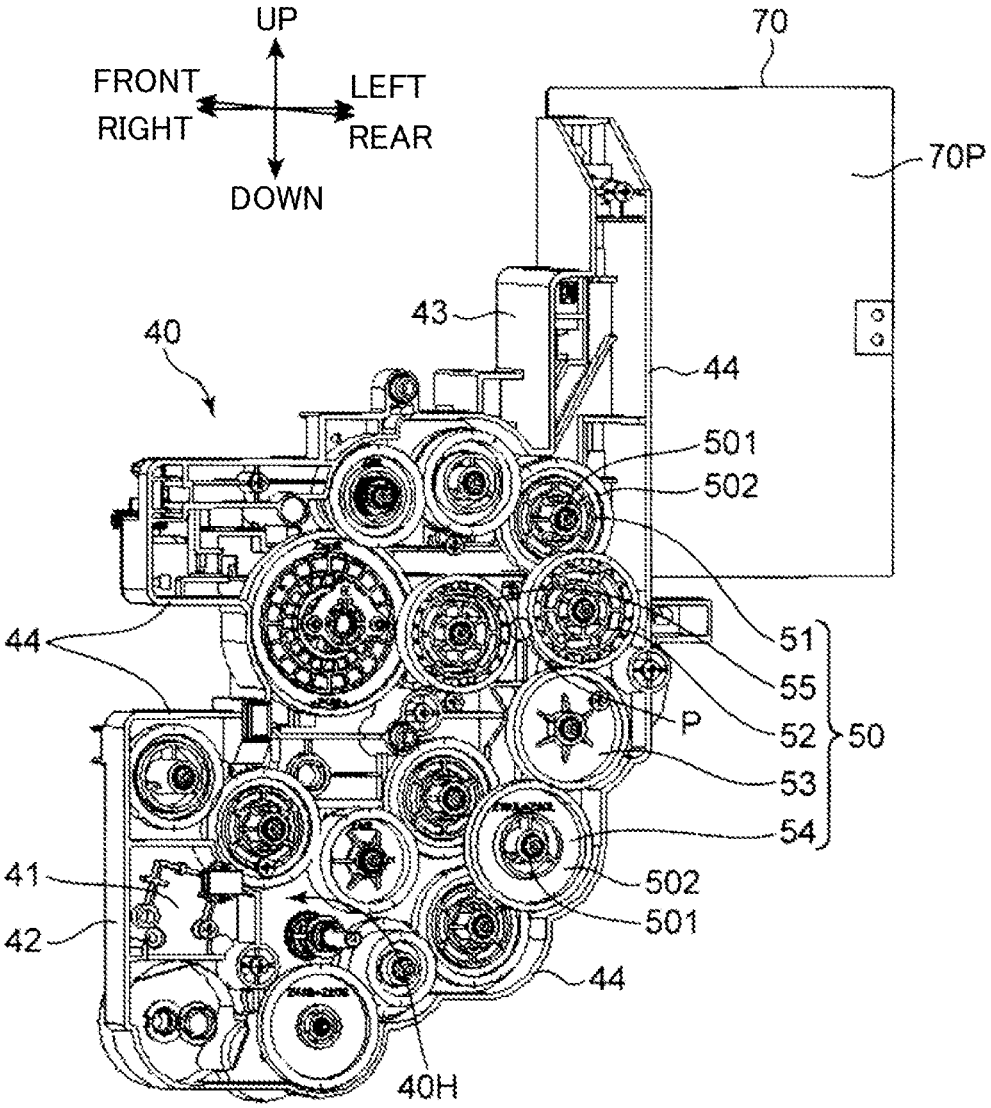
FIG. 6 is a perspective view of the drive housing of the image forming apparatus shown in FIG. 1 as viewed from the opening side.

FIG. 5 is a perspective view showing the drive housing 40 to which the high voltage substrate 70 is attached and the side plate frame piece 310 forming a part of the rear side plate frame 31. FIG. 6 is a perspective view of the drive housing 40 as viewed from the opening side. The drive housing 40 is a resin member molded using a rigid resin material having electrical insulation, and includes a generally planar bottom plate 41 (supporting side surface) and a side plate 42 provided upright from the peripheral edge of the bottom plate 41. The drive housing 40 also includes, at its upper left portion, a substrate supporting portion 43 that supports the high voltage substrate 70. The substrate supporting portion 43 is a portion formed by extending the bottom plate 41 and the side plate 42 so as to protrude toward the upper left.

The upright edge of the side plate 42 is an opening edge 44 of the drive housing 40. More specifically, the drive housing 40 is a bottomed container being open on its side opposing the bottom plate 41 and having a cavity 40H corresponding to the upright height of the side plate 42. The cavity 40H is a space for accommodating the drive gear group 50. The drive housing 40 is attached to the rear side plate frame 31 such that the opening is sealed by the inner side surface 31A of the rear side plate frame 31 (side plate frame piece 310), or more specifically, such that the opening edge 44 abuts the inner side surface 31A.

The drive gear group 50 is composed of an array of a plurality of drive gears 51, 52, 53, 54, 55, . . . serving as a reduction gear and an idle gear, for example. The drive gear group 50 transmits the rotational driving force of the drive motor M to the rotational members (e.g., the photosensitive drum 211, the developing roller 231, and the fixing roller 251) provided in the drum unit 21, the developing unit 23, or the fixing unit 25, or to the rotational members (e.g., the sheet feed roller pair 272 and the registration roller pair 273) that convey sheets. The side plate 42 has a shape surrounding the periphery of the drive gear group 50 generally tightly. However, the substrate supporting portion 43 is not a portion following the peripheral shape of the drive gear group 50, and no drive gear is accommodated in the substrate supporting portion 43.

Figure 8:
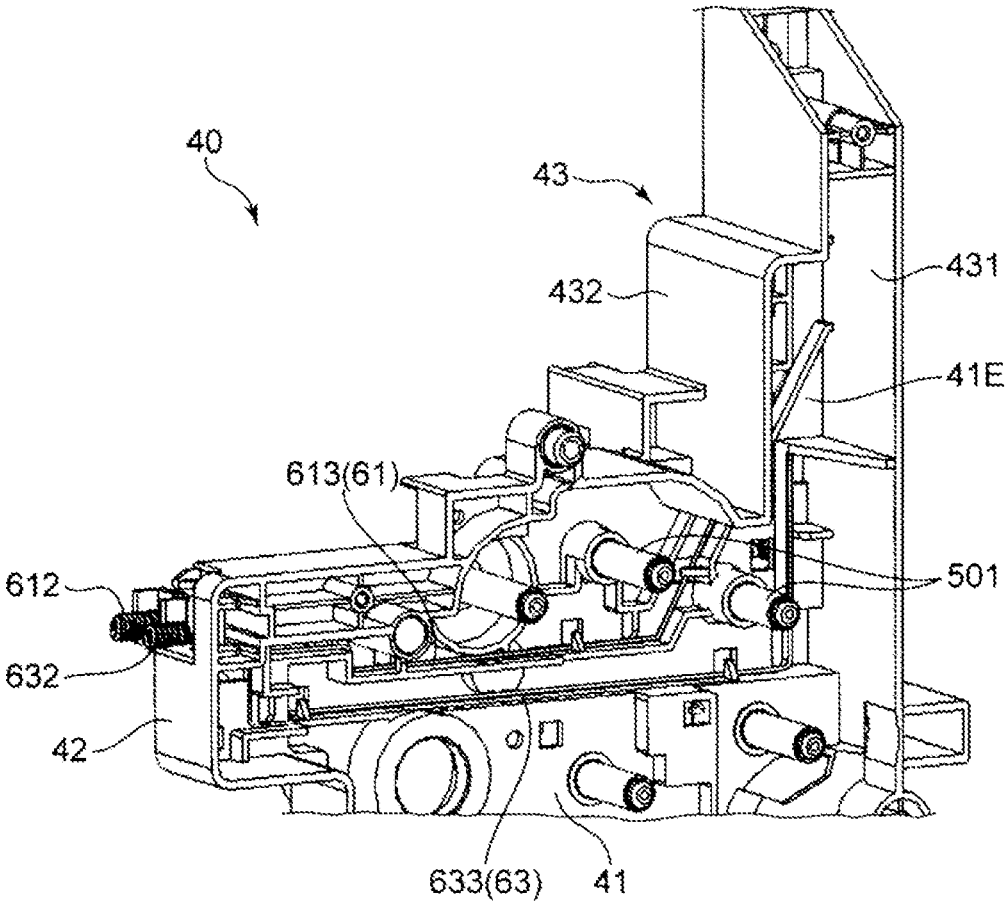
FIG. 8 is a perspective view of the substrate supporting portion of the drive housing and a peripheral region thereof of the image forming apparatus shown in FIG. 1 in a state in which a drive gear group is removed, as viewed from the direction of the outer side surface of the rear side plate frame.

Each of the drive gears 51, 52, 53, 54, 55, . . . is provided with a gear body 502 that rotates about the axis of a rotational shaft 501. As shown in FIG. 8, one end of the rotational shaft 501 is supported by the bottom plate 41, and the other end of the rotational shaft 501 is provided upright in the direction perpendicular to the bottom plate 41. In other words, the other end of the rotational shaft 501 is the opening side of the drive housing 40. In addition, the output shaft of the drive motor M is meshed with the drive gears 51 and 55. The area indicated by the circle denoted by reference symbol P in FIG. 6 is the meshed position of the output shaft of the drive motor M. Since the drive motor M is attached to the outer side surface 31B of the rear side plate frame 31 made of sheet metal, the heat generated by the drive motor M can be dissipated by the rear side plate frame 31.

The high voltage substrate 70 is a circuit board that carries electric components for high voltage for operating the image forming units. The electric components are, for example, a power semiconductor element and a rectifier for applying a predetermined operating voltage and a bias voltage to the drum unit 21, the exposure unit 22, the developing unit 23, the transfer roller 213 and so forth. The high voltage substrate 70 is a vertically elongated rectangular substrate, and includes a mount surface 70P on which the electric components are mounted, and first, second, third, and fourth contact portions 71, 72, 73, and 74 arranged in the up-down direction on the right side portion of the mount surface 70P (these components are located on the rear side of the surface shown in FIG. 5). The first, second, third, and fourth contact portions 71, 72, 73, and 74 are electrically connected to a predetermined electric component mounted on the mount surface 70P.

Figure 7:
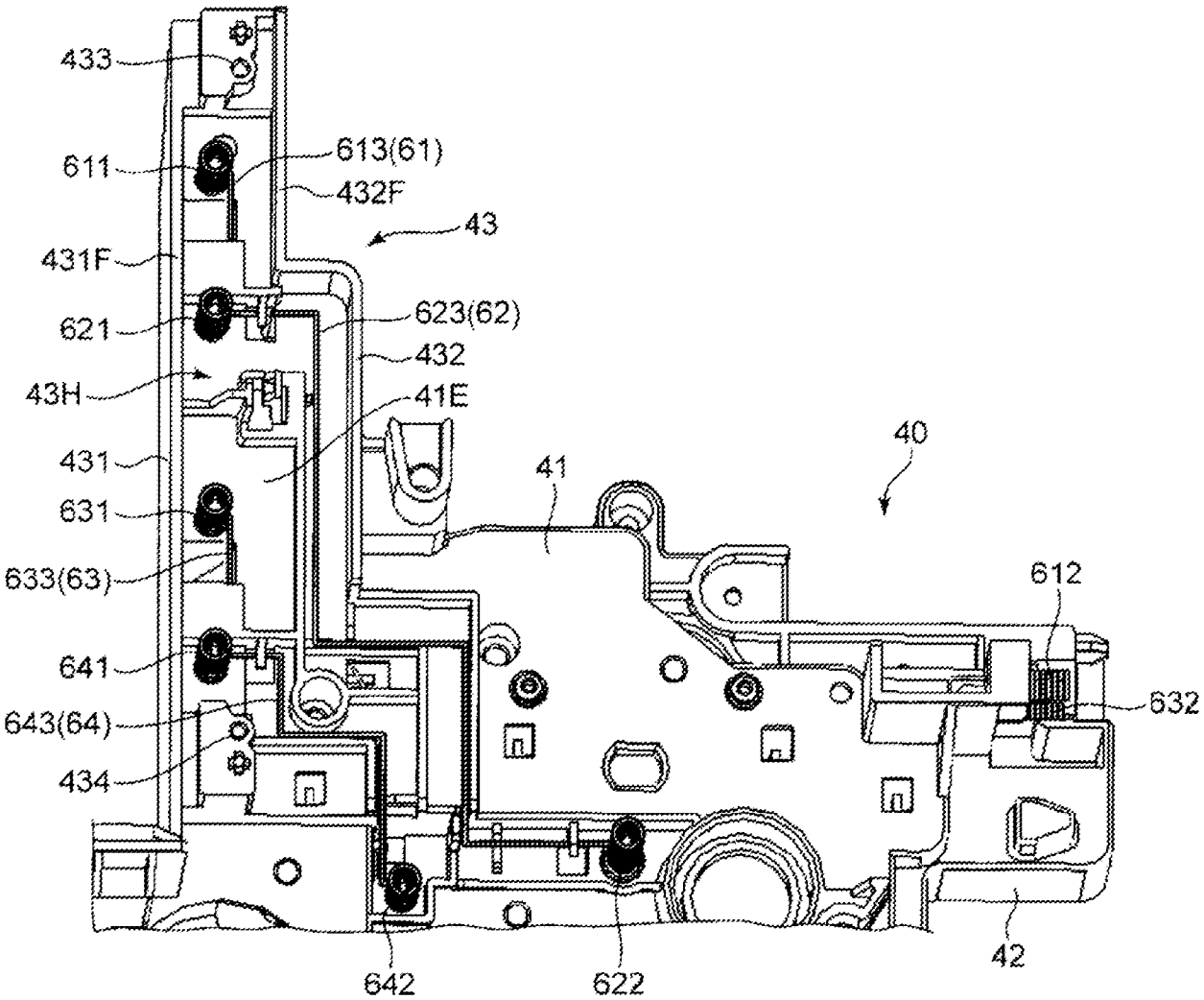
FIG. 7 is a perspective view of a substrate supporting portion of the drive housing and a peripheral region thereof of the image forming apparatus shown in FIG. 1 as viewed from the direction of the inner side surface of the rear side plate frame.

FIG. 7 is a perspective view of the substrate supporting portion 43 of the drive housing 40 and a peripheral region thereof as viewed from the direction of the inner side surface 31A of the rear side plate frame 31. FIG. 8 is a perspective view of the same in a state in which the drive gear group 50 is removed, as viewed from the direction of the outer side surface 31B of the rear side plate frame 31. The substrate supporting portion 43 includes a left supporting plate 431 extending in the up-down direction and a right supporting plate 432 disposed with an interval on the right side of the left supporting plate 431 and extending in the up-down direction (partially including a curved portion).

The left supporting plate 431 and the right supporting plate 432 have a height (width in the front-rear direction) greater than the height of the side plate 42. While the side plate 42 is provided upright rearward relative to the bottom plate 41, the left supporting plate 431 and the right supporting plate 432 extend not only rearward but also forward relative to the bottom plate 41. Specifically, the substrate supporting portion 43 includes an extended planar portion 41E lying on substantially the same horizontal plane as the bottom plate 41, and is provided with a shape such that the lateral opposite edges of the extended planar portion 41E support a region near the center of the left supporting plate 431 and the right supporting plate 432 in the front-rear direction. Accordingly, a cavity 43H corresponding to the amounts of protrusion of the left supporting plate 431 and the right supporting plate 432 in the forward direction is formed on the front side of the extended planar portion 41E.

The upper end portions of the front edge 431F of the left supporting plate 431 and the front edge 432F of the right supporting plate 432 are abutted against the mount surface 70P of the high voltage substrate 70. The substrate supporting portion 43 is provided with a flat portion having a first screw hole 433 near its upper end, and a flat portion having a second screw hole 434 near its lower end. As shown in FIG. 5, the high voltage substrate 70 is fixed to the substrate supporting portion 43 by screwing a first screw 751 and a second screw 752 to the first screw hole 433 and the second screw hole 434, respectively. The right side portion of the high voltage substrate 70 is fixed to the substrate supporting portion 43, and the portions of the high voltage substrate 70 other than the right side portion protrude to the left relative to the substrate supporting portion 43 (drive housing 40).

The drive housing 40 holds a plurality of connecting members made of a so-called wire spring formed by a bare conductor wire that electrically connect the contact portions of the high voltage substrate 70 to contact portions respectively provided in the image forming units. The drive housing 40 is made of a resin material having electrical insulation, and thus is capable of holding a plurality of the connecting members while ensuring electrical insulation. In the present embodiment, the first, second, third, and fourth connecting members 61, 62, 63, and 64 that electrically connect the first, second, third, and fourth contact portions 71, 72, 73, and 74 of the high voltage substrate 70 to the contact portions (not shown) respectively provided in the image forming units is attached to the drive housing 40.

Figure 9:
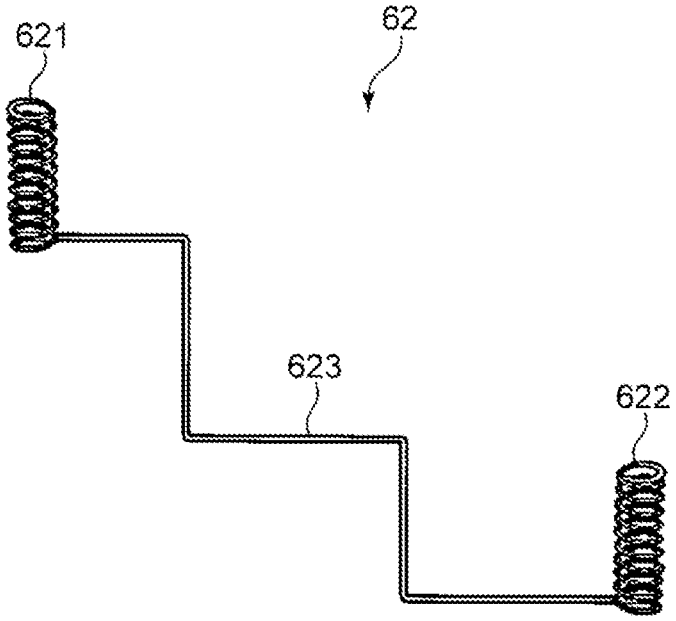
FIG. 9 is a perspective view of a connecting member of the image forming apparatus shown in FIG. 1.

The first to fourth connecting members 61 to 64 are made of a conductive metal wire, and each include a lead wire and a coil-spring terminal member provided on either end of the lead wire. Specifically, the first connecting member 61 includes a first lead wire 613, and a first substrate terminal 611 and a first unit terminal 612 that are provided continuously with one end and the other end, respectively, of the first lead wire 613. The second connecting member 62 includes a second lead wire 623, and a second substrate terminal 621 and a second unit terminal 622 that are provided continuously with one end and the other end, respectively, of the second lead wire 623. FIG. 9 shows the second connecting member 62. The third connecting member 63 includes a third lead wire 633, and a third substrate terminal 631 and a third unit terminal 632 that are provided continuously with one end and the other end, respectively, of the third lead wire 633. The fourth connecting member 64 includes a fourth lead wire 643, and a fourth substrate terminal 641 and a fourth unit terminal 642 that are provided continuously with one end and the other end, respectively, of the fourth lead wire 643.

Each of the first, second, third, and fourth lead wires 613, 623, 633, and 643 is routed on the surface of the bottom plate 41 and the extended planar portion 41E, and is bent along a predetermined wiring path. The second lead wire 623 of the second connecting member 62 shown in FIG. 9 is provided with four right-angled bent portions. As shown in FIG. 7, the first, second, third, and fourth substrate terminals 611, 621, 631, and 641 (second terminal members) are aligned in the up-down direction, and disposed within the cavity 43H of the substrate supporting portion 43. The first substrate terminal 611 is disposed within the substrate supporting portion 43 in a state in which its basal end portion provided continuously with the first lead wire 613 is in contact with the inner surface of the extended planar portion 41E and its proximal end portion, which is the winding end of the coil spring, is provided upright perpendicularly to the extension portion 41E. The second, third, and fourth substrate terminals 621, 631, and 641 arranged sequentially below the first substrate terminal 611 are disposed within the substrate supporting portion 43 in a similar configuration.

In a state in which the high voltage substrate 70 is supported by the substrate supporting portion 43, the first, second, third, and fourth substrate terminals 611, 621, 631, and 641 come into contact with and thereby into electrical communication with the first, second, third, and fourth contact portions 71, 72, 73, and 74, respectively. FIG. 5 shows a state in which such electrical communication is established. In this state, the first to fourth connecting members 61 to 64 are each electrically connected to a power supply circuit (electric component) carried on the high voltage substrate 70, thus achieving a state in which an appropriate bias can be applied to the first, second, third, and fourth unit terminals 612, 622, 632, and 642 (first terminal members).

Each of the first, second, third, and fourth unit terminals 612, 622, 632, and 642 is disposed at an appropriated location of the drive housing 40 according to the position at which the image forming unit to which a bias is to be applied is disposed. The first and third unit terminals 612 and 632 are provided protruding to the right from the right side plate 42 of the drive housing 40. To achieve such wiring, a part of the first and third lead wires 613 and 633 is routed through the interior of the drive housing 40 (FIG. 8). The second and fourth unit terminals 622 and 642 are provided protruding to the front from the bottom plate 41 toward the internal space 30H. The second and fourth lead wires 623 and 643 are routed on the outside (the side facing the internal space 30H) of the drive housing 40 (FIG. 7).

In the present embodiment, the first unit terminal 612 is a terminal for applying a transfer bias to the transfer roller 213, the second unit terminal 622 is a terminal for applying a developing bias to the developing roller 231, the third unit terminal 632 is a terminal for applying a separation bias (a bias for causing a sheet to be detached from the photosensitive drum 211 and having a polarity opposite to the transfer bias) to a sheet separation portion 215, and the fourth unit terminal 642 is a terminal for applying a charging bias to the charging device 212. When the drum unit 21, the developing unit 23, and the conveyance unit 26 are appropriately mounted to the body housing 10, the unit terminals 612, 622, 632, and 642 come into contact with the contact portions (not shown) respectively provided in these units.

With this configuration of the present embodiment, the opening side of the drive housing 40 that accommodates the drive gear group 50 is closed by the rear side plate frame 31. Accordingly, it is possible to achieve a structure capable of reducing the operation noise of the gears by sandwiching the drive gear group 50 between the bottom plate 41 and the inner side surface 31A of the rear side plate frame 31, while reducing the number of components of the drive housing 40 by providing the opening. Since the high voltage substrate 70 is supported by the substrate supporting portion 43 of the drive housing 40, it is not necessary to separately provide an attachment position and an attachment component (e.g., a terminal block) for attaching the high voltage substrate 70 to the rear side plate frame 31. Thus, it becomes possible to reduce the number of components and easily secure the attachment position.

In contrast, the drive gear unit of a conventional image forming apparatus includes an array of a plurality of drive gears and a resin housing that covers the array. In general, the drive gear unit is attached to the outer side surface of the side plate frame. A terminal block is installed at a position on the side plate frame that is different from the attachment position of the drive gear unit, and the high voltage substrate is assembled to the terminal block. Thus, the number of components tends to increase. Also, there is the problem that the attachment positions of the drive gear unit and the high voltage substrate to the side plate frame need to be separately secured.

Moreover, the drive housing 40 also functions as a member that holds the first to fourth unit terminals 612, 622, 632, and 642, which serve as the terminals for supplying power to the image forming units, in an electrically insulated state. Thus, the number of components can be further reduced. Furthermore, since the drive housing 40 serves as a member that holds the first to fourth connecting members 61 to 64, which electrically connect the high voltage substrate 70 to the image forming units, in an electrically insulated state, it is possible to reduce the number of components as compared with when a routing member is separately used.

Figure 10:
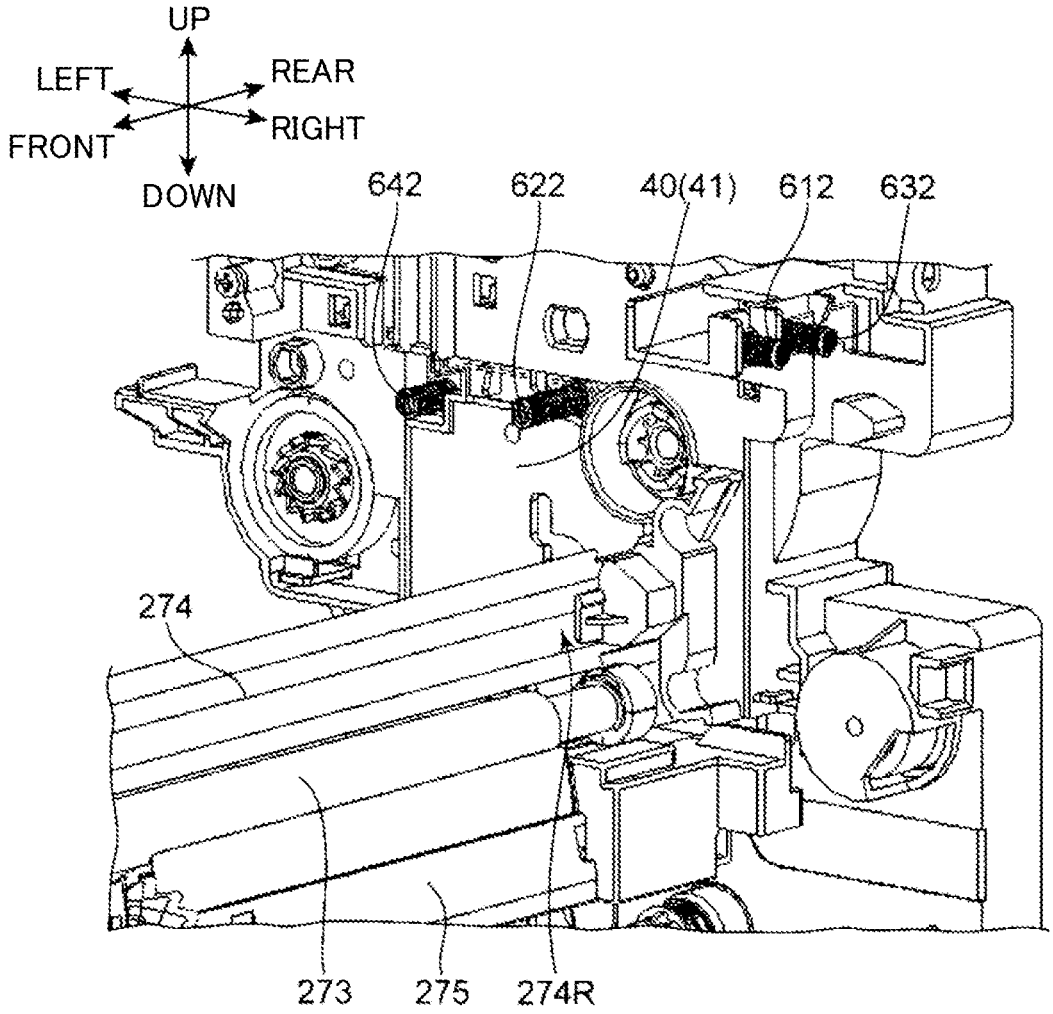
FIG. 10 is a perspective view showing a state in which a pre-transfer guide is mounted to the drive housing of the image forming apparatus shown in FIG. 1.
Figure 11:
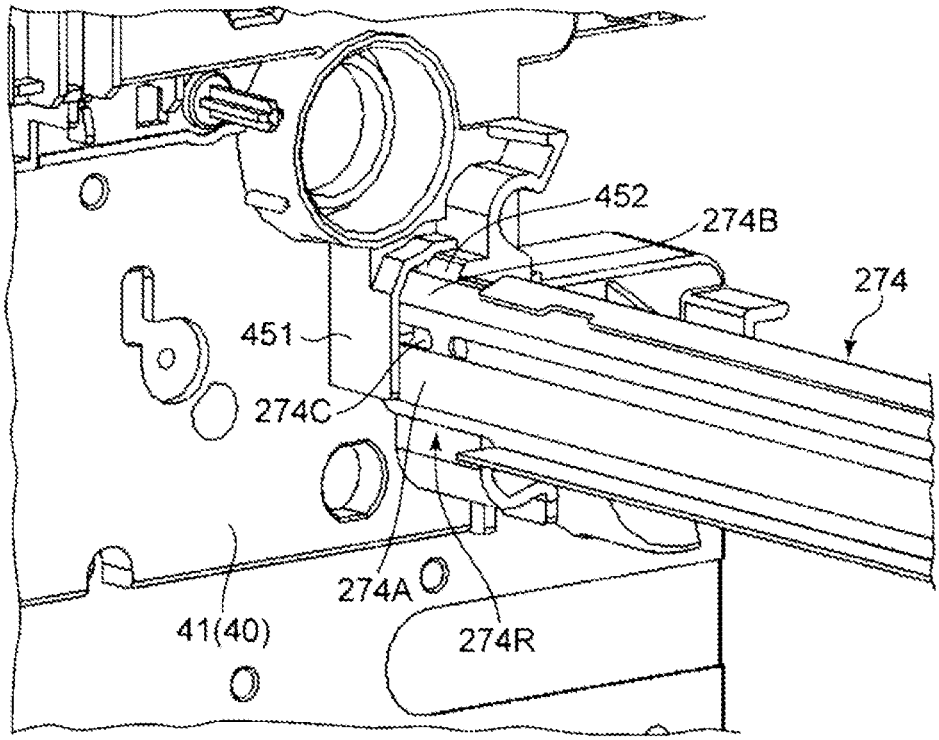
FIG. 11 is an enlarged perspective view of the portion where the pre-transfer guide is mounted to the drive housing portion of the image forming apparatus shown in FIG. 1.
Figure 12:
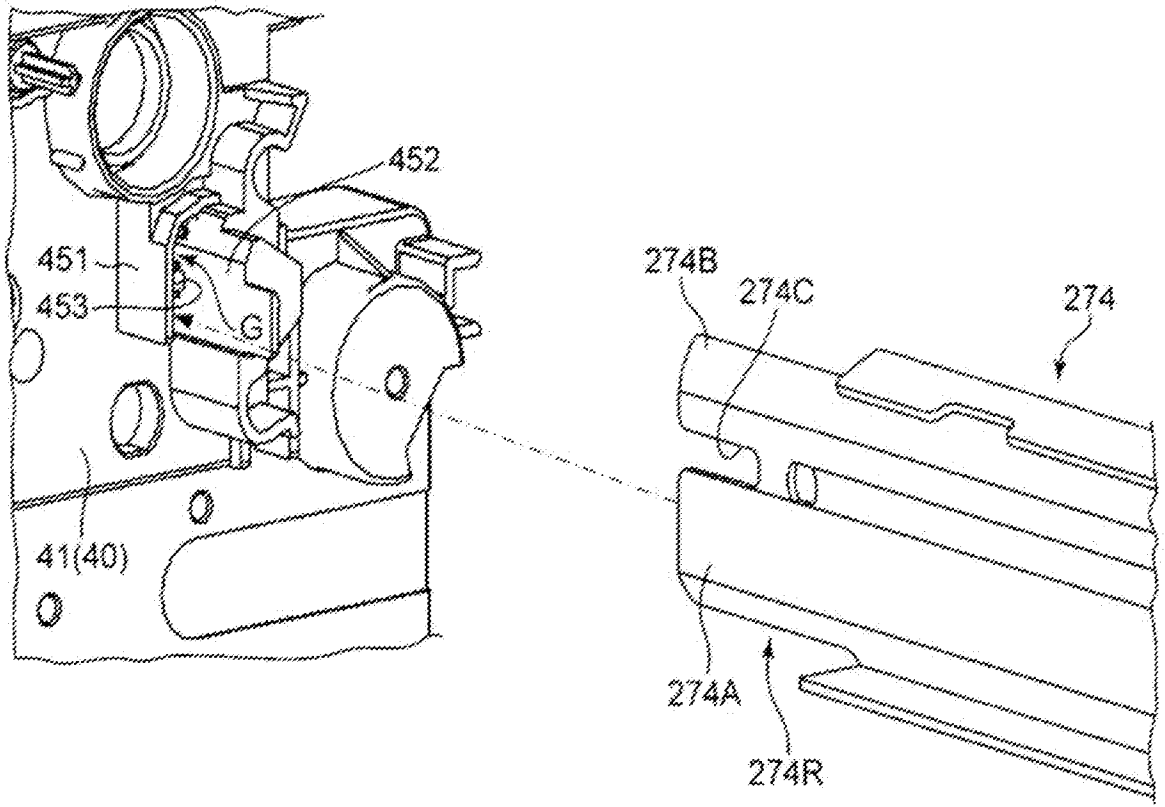
FIG. 12 is a perspective view showing a state before the pre-transfer guide is mounted to the drive housing of the image forming apparatus shown in FIG. 1.

The drive housing 40 of the present embodiment is further provided with the function of positioning the members and units mounted to the frame structure 30. This will be described with reference to FIGS. 10 to 12. FIG. 10 is a perspective view showing a state in which the pre-transfer guide 274 (guide member) is mounted to the drive housing 40. FIG. 11 is an enlarged perspective view (but from a perspective different from that of FIG. 10) of the portion where the pre-transfer guide 274 is mounted. FIG. 12 is a perspective view showing a state before the pre-transfer guide 274 is mounted to the drive housing 40.

The bottom plate 41 of the drive housing 40 is provided with a positioning piece 451 and a boss portion 452 (mounting engagement portions) that protrude in the forward direction toward the internal space 30H. The positioning piece 451 and the boss portion 452 are portions with which the rear end portion 274R of the pre-transfer guide 274 is engaged in order to position the pre-transfer guide 274 relative to the frame structure 30. The pre-transfer guide 274 is formed of a plate having a bent shape corresponding to the conveyance path of the main conveyance path P1. The rear end portion 274R of the pre-transfer guide 274 is provided with a lower protruding piece 274A, an upper protruding piece 274B, and a slit portion 274C formed between the lower protruding piece 274A and the upper protruding piece 274B.

The positioning piece 451 is a protruding plate having a bent shape conforming to the shape of the rear end portion 274R of the pre-transfer guide 274. The boss portion 452 is a member protruding so as to be spaced apart from the positioning piece 451 by a gap G generally equal to the thickness of the pre-transfer guide 274. The surface (left surface) of the boss portion 452 facing the positioning piece 451 has a bent shape conforming to the shape of the rear end portion 274R. On the right surface of the positioning piece 451, a guide strip 453 extending in the front-rear direction is provided so as to protrude into the gap G. The guide strip 453 has a shape that is tightly engaged with the slit portion 274C.

During assembly of the pre-transfer guide 274 to the frame structure 30, as shown in FIG. 12, the rear end portion 274R of the pre-transfer guide 274 is inserted toward the gap G between the positioning piece 451 and the boss portion 452. At this time, the lower protruding piece 274A and the upper protruding piece 274B are guided to the left surface of the boss portion 452. Then, while the slit portion 274C is being fitted to the guide strip 453, the rear end portion 274R is accommodated into the gap G. Upon completion of this accommodation, the positioning of the pre-transfer guide 274 is also completed. In addition to this configuration, for example, the conveyance guide member 275 and a part of the drum unit 21 may also be engaged with the drive housing 40, and the drive housing 40 may be used to achieve the positioning. With this configuration, the drive housing 40 can also be provided with the function of the positioning member for the pre-transfer guide 274 and the image forming units. Accordingly, the number of components required for positioning can be reduced.

With the image forming apparatus 1 according to the present embodiment described above, it is possible to reduce the number of components associated with the image forming apparatus including a unit that accommodates the drive gear group 50 and the high voltage substrate 70, and readily secure the attachment positions thereof. That is, the drive housing 40 is provided with the functions of the terminal block for the high voltage substrate 70 and the member for positioning the pre-transfer guide 274, and it is therefore not necessary to provide these members. Furthermore, since the opening of the drive housing 40 is also sealed by using the rear side plate frame 31, it is possible to reduce the number of components while ensuring sound insulation by using a configuration in which the drive gear group 50 is sandwiched between a pair of wall surfaces. Thus, it is possible to facilitate the operation of assembling the image forming apparatus 1, and also to achieve cost reductions.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming unit;

a frame structure forming a housing structure including an internal space that accommodates the image forming unit, the frame structure including at least one metal side plate frame having an inner side surface facing the internal space and an outer side surface opposite the inner side surface;

a plurality of rotational shafts;

a plurality of drive gears each rotating about an axis of the rotational shaft;

a resin drive housing including a supporting side surface that supports one end of the rotational shaft and a cavity in which the plurality of drive gears is accommodated, the drive housing being open at an open side at another end of the rotational shaft;

a high voltage substrate that carries, on one surface thereof, an electric component for operating the image forming unit;

a connecting member made of a conductive metal and including a lead wire and a first terminal member provided at one end of the lead wire and serving as a contact for supplying power to the image forming unit, wherein the drive gears, the drive housing, the high voltage substrate, and the connecting member are disposed within the internal space, the drive housing integrally includes a substrate supporting portion that supports the high voltage substrate, and is attached to the side plate frame such that the open side of the drive housing is sealed by the inner side surface of the side plate frame, and the drive housing has electrical insulation and holds the connecting member:

the high voltage substrate includes a contact portion on the one surface thereof and electrically connected to the electric component, the connecting member further includes a second terminal member provided at another end of the lead wire, and the second terminal member is disposed at the substrate supporting portion, and the contact portion and the second terminal member come into contact with each other in a state in which the high voltage substrate is supported by the substrate supporting portion;

a guide member that guides a sheet on which image forming processing is to be performed, wherein the drive housing includes a mounting engagement portion that is engaged with the guide member so as to position the guide member or the part of the image forming unit at a predetermined mounting position in the internal space.

2. The image forming apparatus according to claim 1, further comprising a drive motor that provides driving force to the plurality of drive gears, wherein the drive motor is attached to the outer side surface of the side plate frame.

* * * * *